US007012378B1

(12) United States Patent
Wells et al.

(10) Patent No.: US 7,012,378 B1
(45) Date of Patent: Mar. 14, 2006

(54) PROGRAMMABLE CURRENT SOURCE AND METHODS OF USE

(75) Inventors: Michael A. Wells, Chandler, AZ (US); David F. Mietus, Phoenix, AZ (US)

(73) Assignee: Next Sierra, Mountainview, CA (US)

( * ) Notice: Subject to any disclaimer, the term of this patent is extended or adjusted under 35 U.S.C. 154(b) by 183 days.

(21) Appl. No.: 10/773,962

(22) Filed: Feb. 6, 2004

(51) Int. Cl.
*G05F 1/00* (2006.01)

(52) U.S. Cl. ..... 315/194; 315/291; 315/307

(58) Field of Classification Search ..... 315/194, 315/224, 291, 307, 209 R; 330/257, 259, 330/261
See application file for complete search history.

(56) References Cited

U.S. PATENT DOCUMENTS 4,319,298 A * 3/1982 Davis et al. ..... 361/24
6,018,219 A * 1/2000 Komarek et al. ..... 315/194
2003/0023884 A1 * 1/2003 See et al. ..... 713/300

* cited by examiner

*Primary Examiner*—Wilson Lee
*Assistant Examiner*—Jimmy Vu
(74) *Attorney, Agent, or Firm*—Parsons & Goltry; Michael A. Parsons; Michael W. Goltry

(57) ABSTRACT

A programmable multiple current source includes a plurality of current source circuits each having current level data storage circuitry. A current level data input terminal and a control input terminal are connected to each current source circuit to supply current level data to the storage circuitry. Peak detector and storage circuitry is coupled to each of the output terminals of the current source circuits. Each associated current source circuit includes a master digital-to-analog converter coupled to the current level data storage circuitry, a driver circuit coupled to the digital-to-analog converter and to the associated current source circuit, comparator and storage circuitry having a first input coupled to the peak detector and storage circuitry and a second input coupled to the driver circuit, and current level adjustment circuitry coupled to the comparator and storage circuitry and the driver circuit.

23 Claims, 7 Drawing Sheets

Despite transistors N1 and N2 being the same size, the resulting currents $I_{DSN1}$ and $I_{DSN2}$ will not be equal due to intrinsic parametric differences introduced during fabrication of the transistors.

PROGRAMMABLE CURRENT SOURCE AND METHODS OF USE

FIELD OF THE INVENTION

This invention relates to programmable current sources for use in electronic devices.

More particularly, the present invention relates to programmable current sources that provide multiple current source inputs to a plurality of similar circuits.

BACKGROUND OF THE INVENTION

Multiple programmable current sources are generally fabricated as an integrated circuit chip designed to accept data and control signals as inputs and deliver constant, electric currents as outputs to other electronic circuits, such as light-emissive displays and other systems requiring multiple, programmable current sources as inputs. Using light-emissive displays as an example, such displays generally consist of a matrix of rows and columns of pixels (from hundreds to thousands, depending upon the size and definition of the display). The rows are generally designated 0 through R and the columns are designated 0 through N. It should be understood that rows and columns can be interchanged throughout this disclosure and no use of the terms 'rows' or 'columns' is intended in any way to limit the structure or the scope of the invention.

A complete screen is usually produced by cycling the rows periodically from 0 to R and supplying to each column an amount of current required to produce the desired luminance in each pixel in the activated row. Thus, for example, when row 0 is activated a current is supplied to each column 0 through N, when row 1 is activated a different current (possibly) is supplied to each column 0 through N, etc. Since only one row of pixels is activated at a time, only the pixels in that row are driven to emit light by the current applied to the columns. The current applied to each column generally has a plurality of steps or levels that cause the light emissive device in a pixel to emit light in an equal number of steps or levels. During the process of addressing each pixel in a screen, it is desirable for each pixel to have the same brightness or luminance for each step or level.

In many prior art constant current sources a skew or mismatch is exhibited due to intrinsic device parameters in the constant current source circuitry. These skews or mismatches are undesirable and can occur for any type of transistor topology, including but not limited to silicon based NMOS or PMOS transistors. Also, while many different implementations of light-emissive displays (and other systems requiring multiple, programmable current sources) are possible, in most instances the current must flow through a plurality of components (e.g. transistors, capacitances, etc.) connected in series. The intrinsic mismatch between these series components and subsequent series components (e.g. between pixels in a column) causes current variations between the currents flowing in different columns, which produce undesired variations in luminance of the pixels.

It would be highly advantageous, therefore, to remedy the foregoing and other deficiencies inherent in the prior art.

Accordingly, it is an object of the present invention to provide a new and improved programmable current source.

Another object of the invention is to provide a new and improved programmable current source that provides matched currents at multiple outputs.

And another object of the invention is to provide a new and improved programmable current source and a variety of calibration techniques that provides matched currents at multiple outputs.

Still another object of the present invention is to provide a new and improved programmable current source that can be easily incorporated with virtually any circuitry requiring multiple constant current outputs.

Yet another object of the invention is to provide a new and improved programmable current source that is relatively easy and inexpensive to integrate on a single chip.

SUMMARY OF THE INVENTION

Briefly, to achieve the desired objects of the instant invention in accordance with a preferred embodiment thereof, provided is a programmable multiple current source including a plurality of current source circuits each including current level data storage circuitry. A current level data input terminal and a control input terminal are connected to each of the plurality of current source circuits to supply current level data to the storage circuitry in each of the plurality of current source circuits. Peak detector and storage circuitry is coupled to each of the output terminals of the plurality of current source circuits and includes a peak signal output terminal. Each associated current source circuit of the plurality of current source circuits includes a master digital-to-analog converter coupled to the current level data storage circuitry of the associated current source circuit, a driver circuit having an input coupled to the master digital-to-analog converter and an output coupled to the output terminal of the associated current source circuit, comparator and storage circuitry having a first input coupled to the peak signal output terminal of the peak detector and storage circuitry, a second input coupled to the output of the driver circuit, and an output, and current level adjustment circuitry coupled to the output of the comparator and storage circuitry and the input of the driver circuit.

The desired objects of the instant invention are further realized in accordance with a preferred method of calibrating a programmable multiple current source. The method includes a step of providing a plurality of current source circuits each including current level data storage circuitry, each of the plurality of current source circuits including an output terminal, and each of the plurality of current source circuits being constructed to operate at a plurality of current levels from a maximum current level to a minimum current level. The method also includes a step of supplying current level data representative of one current level in the plurality of current levels to the current level data storage circuitry in each of the plurality of current source circuits. Further steps in the method include receiving a plurality of output signals, one each representative of output current at each output terminal of the plurality of current source circuits and sensing a peak output signal in the plurality of received output signals, comparing the output signal representative of output current at each output terminal of the plurality of current source circuits to the sensed peak output signal to determine a difference and generating a plurality of adjustment signals, one each representative of the difference for each of the plurality of current source circuits, storing the plurality of adjustment signals, one each for each of the plurality of current source circuits, and using the stored plurality of adjustment signals, one each for each of the plurality of current source circuits, to adjust the output current at each output terminal of the plurality of current source circuits so that all of the plurality of current source circuits provide substantially matching output currents.

In one specific use of the subject apparatus and method a light-emissive display is provided with a plurality of pixels arranged in an array of rows and columns and the plurality of current source circuits are connected, one each, to each column of the display.

BRIEF DESCRIPTION OF THE DRAWINGS

The foregoing and further and more specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
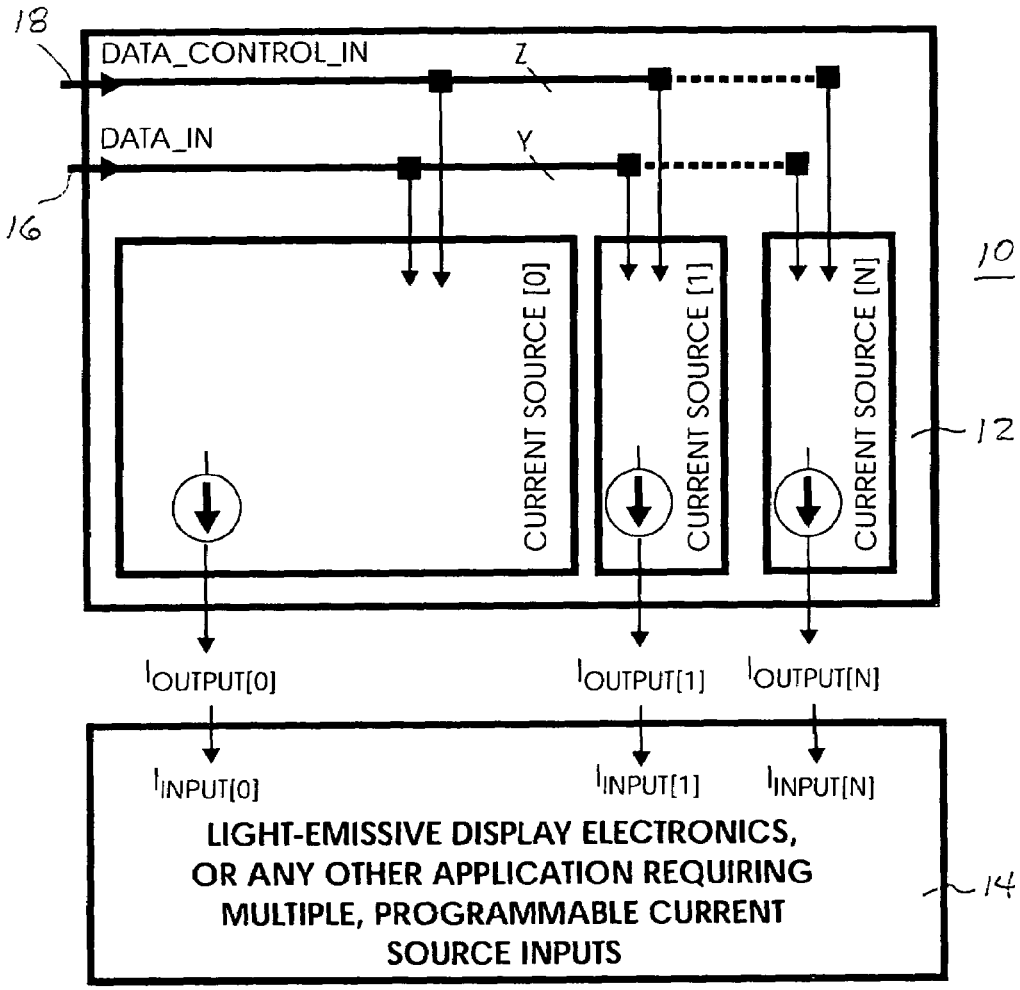
FIG. 1 illustrates a programmable current source chip coupled to a system using multiple, programmable current source inputs.

Turning now to the drawings in which like reference characters indicate corresponding elements throughout the several views, attention is first directed to FIG. 1 which illustrates, generally, an electronic system 10 that includes a programmable current source integrated circuit chip 12 and an electronic circuit 14 connected to receive a plurality of currents N on a similar plurality of output leads 0 through N. Circuit 14 can be any circuit or application, such as a light emissive display, that requires multiple programmable current source inputs. Current source 12 accepts data and control signals on buses 16 and 18, respectively, and delivers programmed constant electric currents on output leads 0 through N to circuit 14. The problem that arises is that prior art constant current sources exhibit skew or mismatch due to intrinsic device parameters.

Figure 2:
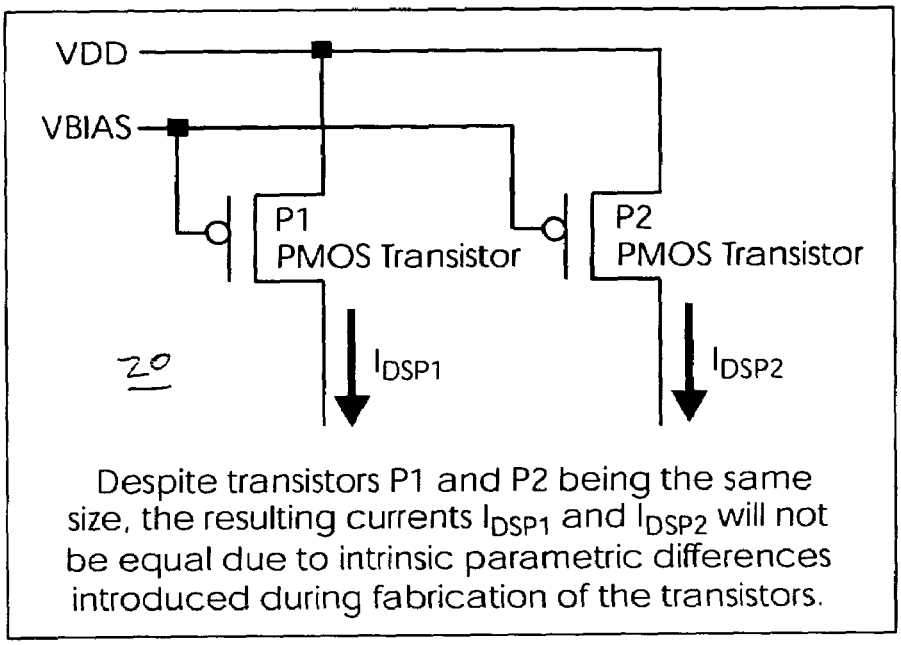
FIGS. 2 and 3 illustrate typical constant current source circuits that exhibit a current skew problem.
Figure 3:
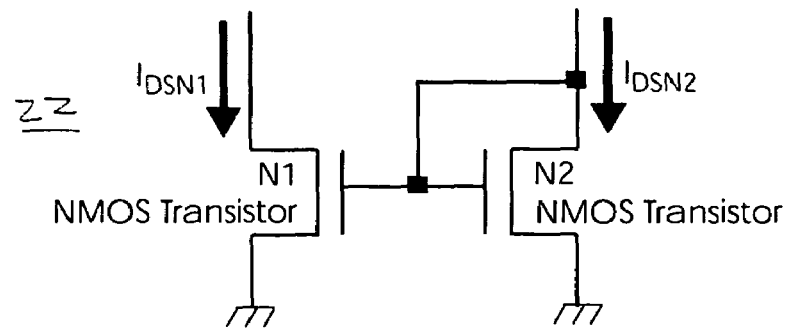

Referring additionally to FIG. 2, an example of a typical prior art constant current source 20 is illustrated. In source 20 a pair of PMOS transistors P1 and P2 are formed on a common chip and connected directly in parallel to conduct equal or matching currents. However, despite the transistors being the same size, because of intrinsic parametric differences introduced during fabrication the currents flowing through transistors P1 and P2 will not be equal. Referring additionally to FIG. 3, an example of a typical prior art constant current source 22 is illustrated. In source 22 a pair of NMOS transistors N1 and N2 are formed on a common chip and the gates are connected directly in parallel to a common source current so that transistors N1 and N2 are expected to conduct equal or matching currents. However, despite the transistors in both cases being the same size (i.e. P1=P2, N1=N2), because of intrinsic parametric differences introduced during fabrication the currents flowing through transistors P1 and P2 or N1 and N2 will not be equal. The differences may be very small but in an industry which must capitalize on the use of very small currents, the differences between currents flowing in transistors P1/P2 and N1/N2 can be a substantial problem.

Figure 4:
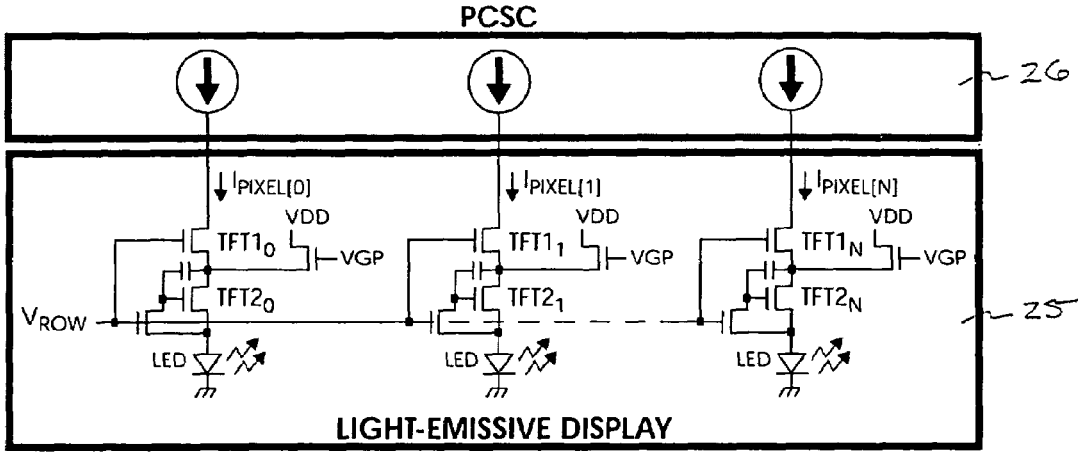
FIG. 4 illustrates a typical example of the problem of providing matched currents at multiple outputs.

Turning now to FIG. 4, a schematic diagram of an example of a typical light emissive display 25 connected to a programmable multiple current source 26 is illustrated. Light emissive display 25 is represented by only three pixels in a single row to simplify the example. It will be understood however, that display 25 will generally include hundreds, or even thousands, of similar pixels in each row and hundreds, or even thousands, of rows. As can be seen in FIG. 4, each pixel includes a plurality of thin film transistors (TFTs) and an LED, or light emissive device. Current flowing from current source 26 flows through any pixels activated by a voltage on the lead $V_{ROW}$. Also, current flowing through any pixel must flow through several components connected in series (e.g. $TFT1_0$ and $TFT2_0$) and the LED to a current return terminal. The intrinsic mismatch between the series connected devices in each pixel (e.g. the difference between the series circuit $TFT1_0$, $TFT2_0$ and the LED and the series circuit $TFT1_N$, $TFT2_N$ and the LED) causes variations in the currents (in this specific example $I_{PIXEL(0)}$ and $I_{PIXEL(N)}$). These current variations cause undesired variations in luminance of the pixels.

Figure 5:
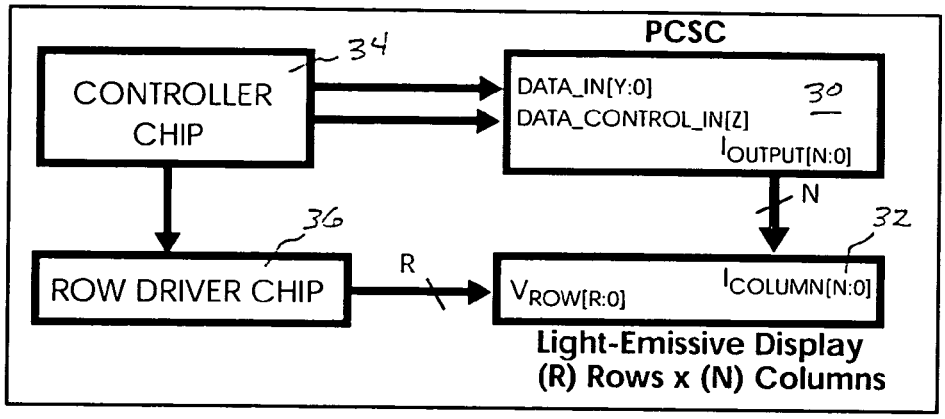
FIG. 5 is a general example of the use of a programmable current source that provides multiple matched currents in accordance with the present invention.

Turning now to FIG. 5, a simplified block diagram of a programmable multiple current source 30 in accordance with the present invention is illustrated in connection with a typical light emissive display for purposes of illustration. In this example, programmable multiple current source 30 provides multiple (N) matched currents to a light emissive display 32 consisting of R rows and N columns of pixels. A controller circuit or chip 34 sends data codes and data control signals to current source 30 causing current source 30 to deliver N matching current outputs to the N columns of display 32. A row driver chip 36 delivers excitation voltage to each of the R rows of display 32 in a regular cycle (i.e. row 0, row 1, etc. through row R and then back to row 0) in response to timing or control signals supplied by controller chip 34.

Figure 6:
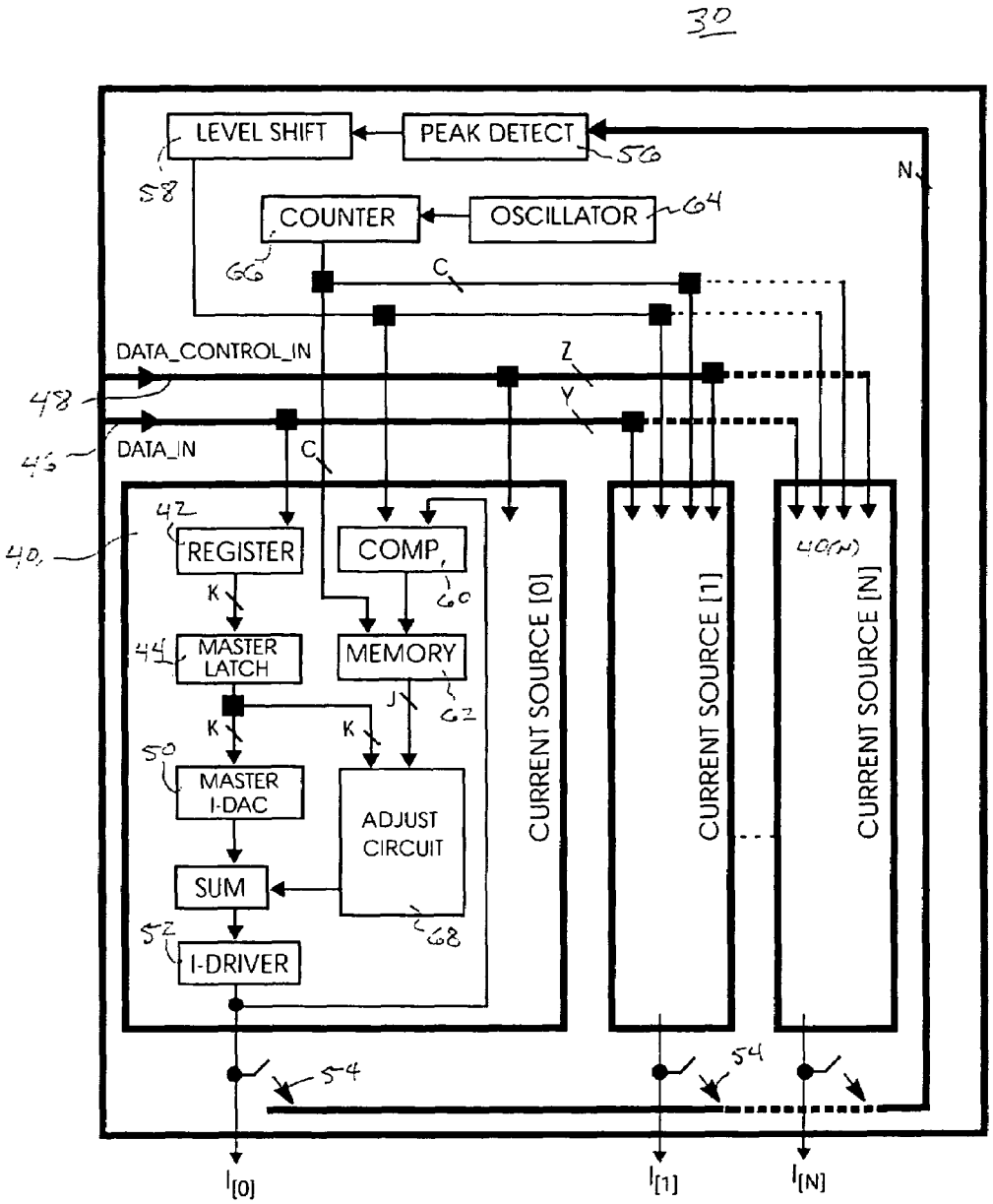
FIG. 6 is a schematic of a programmable current source chip in accordance with the present invention.

Referring additionally to FIG. 6, a more detailed schematic of programmable multiple current source 30 is illustrated. Multiple current source 30 includes a plurality of current source circuits $\mathbf{40}_{(0)}$ through $\mathbf{40}_{(N)}$ each including current level data storage circuitry. In this embodiment the current level data storage circuitry in each associated current source circuits $\mathbf{40}_{(0)}$ through $\mathbf{40}_{(N)}$ includes a register 42 and a latching circuit 44. A current level data input terminal and bus 46 and a control input terminal and bus 48 are connected to each of the plurality of current source circuits $\mathbf{40}_{(0)}$ through $\mathbf{40}_{(N)}$ to supply current level data to the storage. In this example, current level data input terminal and bus 46 and control input terminal and bus 48 are connected to controller chip 34 (see FIG. 5). As will be understood by those skilled in the art, bus 46 carries digital signals (current level data) representative of a specific luminance (or driving current) level for each pixel and bus 48 carries control signals that direct the correct luminance signal to be stored in each register 42 and latch 44 of the current source circuits $\mathbf{40}_{(0)}$ through $\mathbf{40}_{(N)}$.

For example, if light emissive display 32 is constructed to operate with sixty four levels of luminance in each pixel, bus 46 might have as few as six leads (it could include more leads for other functions) to carry the digital code representative of a specific one of the sixty four possible levels. The code for each pixel of the N pixels would appear in parallel on bus 46 and be clocked into the appropriate register 42 by a timing signal on bus 48. In this example, a first six bit current level signal is clocked into register 42 in current source circuit $\mathbf{40}_{(0)}$, a second six bit current level signal is clocked into register 42 in current source circuit $\mathbf{40}_{(1)}$, and so on through register 42 in current source circuit $\mathbf{40}_{(N)}$. Specific connections of bus 48 are not illustrated for simplicity and an easier understanding of the inventive portion of the system.

Each current source circuit $\mathbf{40}_{(0)}$ through $\mathbf{40}_{(N)}$ includes a master digital-to-analog converter 50 coupled to the current level data storage circuitry of the associated current source circuit. In each of the current source circuits, digital-to-analog converter 50 receives the six bit digital signal (in this example) from latch 44 and converts it to the appropriate analog signal, which is then applied to a column driver circuit 52. The output of each of the N driver circuits 52 is applied to an output terminal $I_{(0)}$ through $I_{(N)}$ of the associated current source circuit $\mathbf{40}_{(0)}$ through $\mathbf{40}_{(N)}$. The outputs of all of the N driver circuits 52 are also applied through N switches 54 to the input of peak detector and storage circuitry, which in this embodiment includes a peak detector 56 and a level shift circuit 58. In this embodiment switches 54 are illustrated as single-pole single-throw switches but it will be understood that this is simply a schematic representation and some form of semiconductor may be used so as to be integrated into the chip.

Each current source circuit $\mathbf{40}_{(0)}$ through $\mathbf{40}_{(N)}$ also includes comparator and storage circuitry, which in this embodiment includes a comparator 60 and some convenient form of memory 62. Each comparator 60 includes an input connected to an output of level shift circuit 58 for receiving a signal representative of a peak signal. Each comparator 60 also includes an input connected to driver circuit 52 of the associated current source circuit for receiving an output signal representative of the drive signal at the output $I_{(0)}$ through $I_{(N)}$ of the associated current source circuit. Comparator 60 compares the two input signals and supplies a signal representative of the difference to memory 62. An oscillator 64 and counter 66 may optionally supply a signal to an input of memory 62 for incrementing addresses in memory 62 or for converting the difference signal in comparator 60 to a digital signal for convenient storage in memory 62, as will be described in more detail presently.

An output signal from memory 62 is supplied to an adjustment circuit 68, which supplies an analog compensation or adjustment signal, in conjunction with the analog signal from digital-to-analog converter 50, to the input of driver circuit 52. The analog adjustment signal is specifically generated to bring the drive signal at the output of driver circuit 52, in each of the current source circuits $\mathbf{40}_{(0)}$ through $\mathbf{40}_{(N)}$ into a substantially matching level or state when the same current level data input signal is applied. Generally, the adjustment signal will change or adjust the input signal to driver circuit 52 a small amount or some convenient amount (e.g. a fraction of a level or one complete level). In the preferred method (which will be described presently), the adjusted output signal of driver circuit 52 is again compared to the peak signal in comparator 60 and a second adjustment is generated, if necessary. The adjustment cycle is continued until the output of driver circuit 52 matches the peak signal in comparator 60, at which time the final adjustment signal is stored in adjustment circuit 68 and comparator 60 latches memory 62 to stop or deactivate the process. In some specific adjustment methods, adjustment circuit 68 may use the digital current level data signal stored in latch 44, and, accordingly, a connection for that purpose is illustrated.

A variety of methods for adjusting the driver current at the current outputs $I_{(0)}$ through $I_{(N)}$ of programmable multiple current source 30 to achieve substantially matched currents are possible. For convenience in understanding the present invention and its operation, three potential methods of adjustment are described below. Further, each of the methods is performed during a calibration period that may be performed at any convenient time, e.g. when the display is first turned on, periodically (every half-hour, hour, etc.), or whenever a change in the display is sensed. It will of course be understood by those skilled in the art that modifications of the described methods and other completely different methods may be devised.

In a first method of adjusting or matching the driver current at the current outputs $I_{(0)}$ through $I_{(N)}$, a calibration period includes a calibration cycle performed for each row, row 0 through row R. In the first calibration cycle, a maximum illumination level signal is applied by way of bus 46 to register 42 in each of the current source circuits $\mathbf{40}_{(0)}$ through $\mathbf{40}_{(N)}$ with row 0 of pixels activated. All N switches 54 are closed sequentially so that all N outputs are applied sequentially to peak detector 56 and the peak output is sensed. The peak output is stored and simultaneously applied to each comparator 60 in each current source circuit $\mathbf{40}_{(0)}$ through $\mathbf{40}_{(N)}$. The comparison and adjustment cycle described above is performed in each current source circuit $\mathbf{40}_{(0)}$ through $\mathbf{40}_{(N)}$ until the outputs of all current source circuit $\mathbf{40}_{(0)}$ through $\mathbf{40}_{(N)}$ match at the maximum level with row 0 of pixels activated. The final adjustment signal generated by adjust circuit 68 is stored for use each time row 0 is activated.

A second calibration cycle is then performed with row 1 activated, a third calibration cycle is performed for row 2, and so on through all R rows. In each cycle the final adjustment signal is stored and used each time that row is activated. Thus, R final adjustment signals are stored in each of the N adjustment circuits 68 and applied during actual use of display 32. In this method, it is assumed that the amount of adjustment required at each level of illumination for each pixel will be approximately the same. While a maximum level is used throughout the calibration period, it will be understood that any other level (e.g. one of the mid levels) could be used to develop the amount of adjustment signal required for matching all of the outputs.

In another method of adjusting or matching the driver current at the current outputs $I_{(0)}$ through $I_{(N)}$, a calibration period includes a calibration cycle performed for each row, row 0 through row R. In this method, during a calibration cycle, a pre-selected list of specific level codes are cycled into each register 42 in each of the current source circuits $\mathbf{40}_{(0)}$ through $\mathbf{40}_{(N)}$ with row 0 of pixels activated. The specific level codes could be, for example, 10000, 010000, 001000, 000100, 000010, and 000001, assuming sixty four levels of luminance or drive current. In this example, adjustment circuit 68 will usually include a 6-bit priority encoder. An adjustment signal is generated and stored in each of the N adjustment circuits 68, as described above, for each of the six specific level codes. A second calibration cycle is then performed with row 1 activated and so on through all R rows.

Once the calibration period is completed and display 32 is in normal use, as each row in a screen is activated the level input data cycled into each register 42, for the pixel in the activated row, is provided to adjustment circuit 68. Adjustment circuit 68 determines the most significant digit in the level input data and supplies the adjustment signal that conforms to that digit. For example, when the level input data is 000100 adjustment circuit 68 supplies the adjustment signal developed for specific level code 000100, when the level input data is 000101 adjustment circuit 68 supplies the adjustment signal developed for specific level codes 000100 and 000001, when the level input data is 000111 adjustment circuit 68 supplies the adjustment signal developed for specific level codes 000100, 000010, and 000001, etc.

In another method, every level is adjusted in every pixel. That is, in a first adjustment cycle of an adjustment period, an adjustment signal is developed and stored (as described above) for each of the sixty three levels (skipping of course the zero or off level) of current or luminance of the current source circuits $\mathbf{40}_{(0)}$ through $\mathbf{40}_{(N)}$ with row 0 of pixels activated. In a second adjustment cycle of the adjustment period, an adjustment signal is developed and stored (as described above) for each of the sixty three levels (skipping of course the zero or off level) of current or luminance of the current source circuits $\mathbf{40}_{(0)}$ through $\mathbf{40}_{(N)}$ with row 1 of pixels activated. In this fashion an adjustment signal for each of the sixty three levels is developed and stored for each pixel in each row. Because of the inordinately large number of adjustment signals (63 times R for each column in this example) that must be stored in this method, it is not a preferred method at this time.

Figure 7:
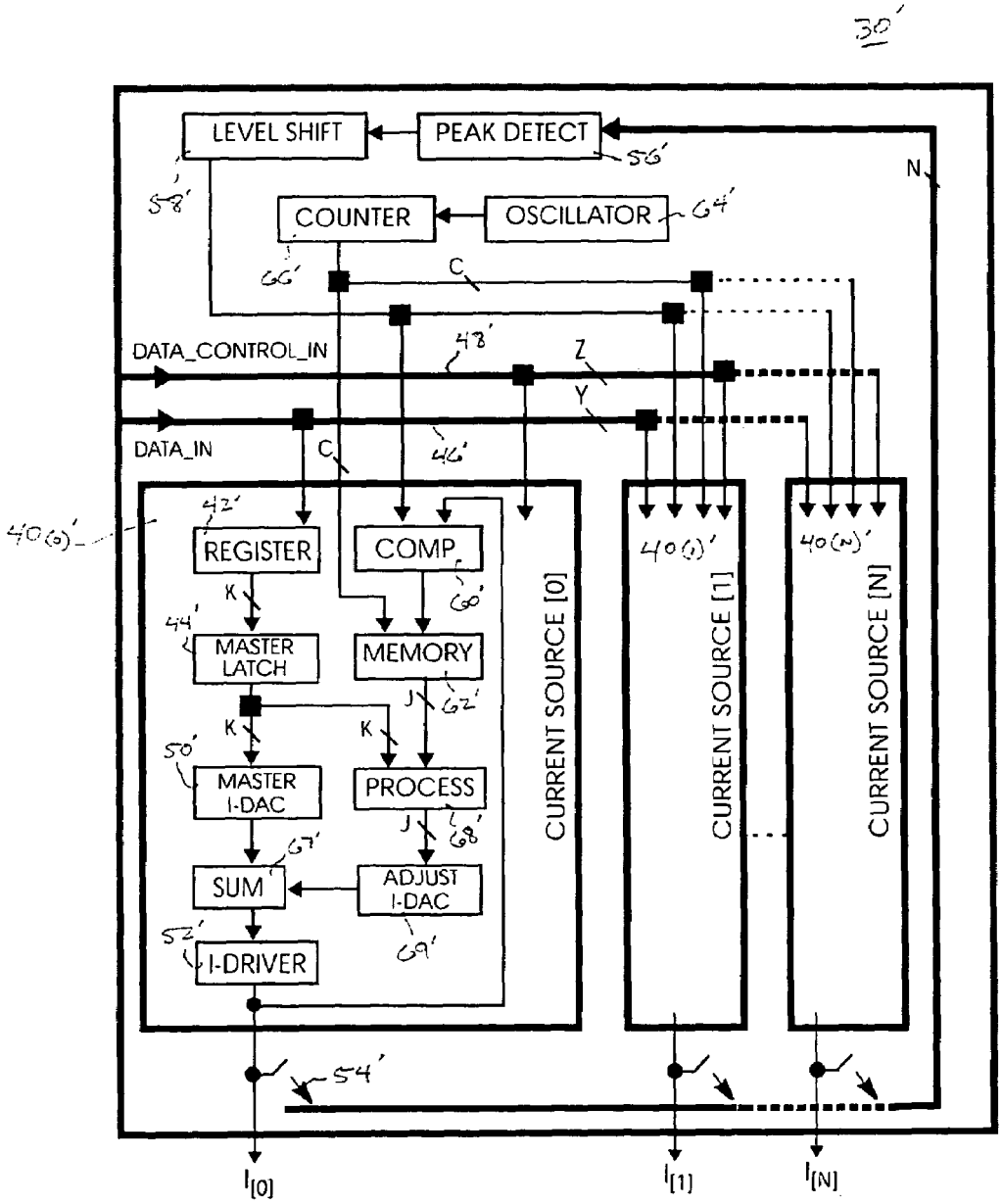
FIG. 7 is a schematic of a specific embodiment of a programmable current source chip in accordance with the present invention.

Referring to FIG. 7, the preferred method of adjusting or matching the driver current at the current outputs $I_{(0)}$ through $I_{(N)}$, is illustrated. In FIG. 7, components that are similar to components in FIG. 6 are designated with similar numbers having a prime added to indicate the different embodiment. Also, components described in conjunction with FIG. 6 will not be further described unless additional or different functions are performed. In this embodiment, adjustment circuit 68 is replaced with a process block 68' and an adjustment digital-to-analog converter 69', the output of which is added to the output of digital-to-analog converter 50' by a summing circuit 67'. It should be noted that in this embodiment a voltage is sensed at the output of driver 52' (even though schematically it is connected to the current output) and supplied to comparator 60'. Also, the output signal from level shift circuit 58' is a voltage, since voltages are generally easier and more accurate to sense and compare. The topology of process block 68' can be defined as the algorithm $$\text{ADJUST FACTOR}=(((A)/2^{(K)})*(B))$$

Where:

A=the J-bit vector output from memory 62',

B=the K-bit vector output from latch 44', and

K=the number of bits used for the level code.

In this method, the adjustment is solely made for the full-scale output current level, 111111, in this example. The adjustment signal is determined for each row R in the display and stored in memory 62'. The adjustment signal applied to the adjustment I-DAC 69' is scaled by processor 68', based on the aforementioned adjust factor equation and the value appearing at the output of master latch 44'.

Thus, a new and improved programmable current source that provides matched currents at multiple outputs is described. A variety of calibration techniques can be used with the new and improved programmable current source to provide matched or substantially matched currents at multiple outputs. Here it will be understood that not all of the methods described provide adjustments for exact matching of all pixels for all levels of luminance but all of the methods described provide multiple outputs that are more closely matched than any known prior art circuits, structures, or devices. The multiple programmable current source can relatively easily be incorporated with virtually any circuitry requiring multiple constant current outputs and is relatively easy and inexpensive to integrate on a single chip.

Various changes and modifications to the embodiment herein chosen for purposes of illustration will readily occur to those skilled in the art. For example, while the described calibration methods use specific levels other or additional levels could be used, fewer rows of pixels could be involved in the calibration methods, depending on the specific application or applications for which is intended to be employed. To the extent that such modifications and variations do not depart from the spirit of the invention, they are intended to be included within the scope thereof.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same,

The invention claimed is:

1. A programmable multiple current source comprising:

a plurality of current source circuits each including current level data storage circuitry, each of the plurality of current source circuits including an output terminal;

a current level data input terminal and a control input terminal connected to each of the plurality of current source circuits to supply current level data to the storage circuitry in each of the plurality of current source circuits;

peak detector and storage circuitry coupled to each of the output terminals of the plurality of current source circuits and including a peak signal output terminal; and each associated current source circuit of the plurality of current source circuits including a master digital-to-analog converter coupled to the current level data storage circuitry of the associated current source circuit, a driver circuit having an input coupled to the master digital-to-analog converter and an output coupled to the output terminal of the associated current source circuit, comparator and storage circuitry having a first input coupled to the peak signal output terminal of the peak detector and storage circuitry, a second input coupled to the output of the driver circuit, and an output, and current level adjustment circuitry coupled to the output of the comparator and storage circuitry and the input of the driver circuit.

2. A programmable multiple current source as claimed in claim 1 wherein the current level data storage circuitry includes a register and latching circuit.

3. A programmable multiple current source as claimed in claim 1 wherein the current level adjustment circuitry includes an adjustment digital-to-analog converter having an output coupled to the input of the driver circuit for supplying an adjustment analog signal in conjunction with a master analog signal from the master digital-to-analog converter.

4. A programmable multiple current source as claimed in claim 1 wherein the comparator and storage circuitry includes an addressable memory.

5. A programmable multiple current source as claimed in claim 4 further including an oscillator driving a counter, the counter having an output coupled to the addressable memory for incrementing addresses.

6. A programmable multiple current source as claimed in claim 1 wherein the first input of the comparator and storage circuitry is coupled to receive a peak voltage signal from the peak signal output terminal of the peak detector and storage circuitry, the second input is coupled to receive a voltage representative of an output signal from the output of the driver circuit, and the comparator is constructed to compare the voltages.

7. A programmable multiple current source as claimed in claim 1 including a light-emissive display with a plurality of pixels arranged in an array of rows and columns, the output terminals of the plurality of current source circuits coupled, one each, to the columns of pixels in the display.

8. A programmable multiple current source as claimed in claim 1 integrated on a single semiconductor chip.

9. A display system with a programmable multiple current source comprising:

a light-emissive display with a plurality of pixels arranged in an array of rows and columns;

a plurality of current source circuits each including current level data storage circuitry, each of the plurality of current source circuits including an output terminal coupled, one each, to a column of pixels in the light-emissive display;

a current level data input terminal and a control input terminal connected to each of the plurality of current source circuits to supply current level data to the storage circuitry in each of the plurality of current source circuits;

peak detector and storage circuitry coupled to each of the output terminals of the plurality of current source circuits and including a peak signal output terminal;

each associated current source circuit of the plurality of current source circuits including a master digital-to-analog converter coupled to the current level data storage circuitry of the associated current source circuit, a driver circuit having an input coupled to the master digital-to-analog converter and an output coupled to the output terminal of the associated current source circuit, comparator and storage circuitry having a first input coupled to the peak signal output terminal of the peak detector and storage circuitry, a second input coupled to the output of the driver circuit, and an output, and current level adjustment circuitry coupled to the output of the comparator and storage circuitry and the input of the driver circuit; and the first input of the comparator and storage circuitry being coupled to receive a peak voltage signal from the peak signal output terminal of the peak detector and storage circuitry, the second input being coupled to receive a voltage representative of an output signal from the output of the driver circuit, and the comparator and storage circuitry being constructed to compare the voltages and supply a signal representative of the difference to the current level adjustment circuitry.

10. A method of calibrating a programmable multiple current source comprising the steps of:

providing a plurality of current source circuits each including current level data storage circuitry, each of the plurality of current source circuits including an output terminal;

supplying current level data representative of a first current level to the current level data storage circuitry in each of the plurality of current source circuits;

receiving an output signal representative of the output current at each output terminal of the plurality of current source circuits and sensing a peak output in the received output signals;

comparing the output signal representative of the output current at each output terminal of the plurality of current source circuits to the sensed peak output and generating an adjustment signal representative of a difference for each of the plurality of current source circuits;

storing the adjustment signal for each of the plurality of current source circuits; and using the stored adjustment signal for each of the plurality of current source circuits to adjust the output current at each output terminal of the plurality of current source circuits.

11. A method as claimed in claim 10 including the steps of providing a light-emissive display with a plurality of pixels arranged in an array of rows and columns and connecting the plurality of current source circuits, one each, to each column of the display.

12. A method as claimed in claim 11 wherein the steps of supplying, receiving, comparing, storing, and using are repeated for each row of pixels in the display.

13. A method as claimed in claim 10 wherein the step of supplying current level data includes a plurality of current levels and the first current level is representative of a highest current level in the plurality of current levels.

14. A method as claimed in claim 10 wherein the step of supplying current level data includes supplying a plurality of selected current levels and the steps of receiving, comparing, storing, and using are repeated for each of the plurality of selected current levels.

15. A method of calibrating a programmable multiple current source comprising the steps of:

providing a plurality of current source circuits each including current level data storage circuitry, each of the plurality of current source circuits including an output terminal, and each of the plurality of current source circuits being constructed to operate at a plurality of current levels from a maximum current level to a minimum current level;

supplying current level data representative of one current level in the plurality of current levels to the current level data storage circuitry in each of the plurality of current source circuits;

receiving a plurality of output signals, one each representative of output current at each output terminal of the plurality of current source circuits and sensing a peak output signal in the plurality of received output signals;

comparing the output signal representative of output current at each output terminal of the plurality of current source circuits to the sensed peak output signal to determine a difference and generating a plurality of adjustment signals, one each representative of the difference for each of the plurality of current source circuits;

storing the plurality of adjustment signals, one each for each of the plurality of current source circuits; and using the stored plurality of adjustment signals, one each for each of the plurality of current source circuits, to adjust the output current at each output terminal of the plurality of current source circuits so that all of the plurality of current source circuits provide substantially matching output currents.

16. A method as claimed in claim 15 wherein the step of supplying one current level in the plurality of current levels includes the step of supplying the maximum current level.

17. A method as claimed in claim 15 wherein the step of supplying current level data includes supplying a plurality of selected current levels and the steps of receiving, comparing, storing, and using are repeated for each of the plurality of selected current levels.

18. A method as claimed in claim 15 including the steps of providing a light-emissive display with a plurality of pixels arranged in an array of rows and columns and connecting the output terminals of the plurality of current source circuits, one each, to each column of the display.

19. A method as claimed in claim 18 wherein the steps of supplying, receiving, comparing, storing, and using are repeated for each row of pixels in the display.

20. A method as claimed in claim 18 wherein the step of supplying current level data includes sequentially supplying a plurality of selected current levels and the steps of receiving, comparing, storing, and using are repeated for each of the plurality of selected current levels for each pixel in each row of pixels.

21. A method of calibrating a programmable multiple current source in a display system comprising the steps of:

providing a plurality of current source circuits each including current level data storage circuitry, each of the plurality of current source circuits including an output terminal, and each of the plurality of current source circuits being constructed to operate at a plurality of current levels from a maximum current level to a minimum current level;

providing a light-emissive display with a plurality of pixels arranged in an array including a plurality of rows of pixels and a plurality of columns of pixels and connecting the output terminals of the plurality of current source circuits, one each, to each column of the plurality of columns;

activating a first row of pixels of the plurality of rows of pixels;

supplying current level data representative of one current level in the plurality of current levels to the current level data storage circuitry in each of the plurality of current source circuits;

receiving a plurality of output signals, one each representative of output current at each output terminal of the plurality of current source circuits and sensing a peak output signal in the plurality of received output signals;

comparing the output signal representative of output current at each output terminal of the plurality of current source circuits to the sensed peak output signal to determine a difference and generating a plurality of adjustment signals, one each representative of the difference for each of the plurality of current source circuits;

storing the plurality of adjustment signals, one each for each of the plurality of current source circuits;

using the stored plurality of adjustment signals, one each for each of the plurality of current source circuits, to adjust the output current at each output terminal of the plurality of current source circuits so that all of the plurality of current source circuits provide substantially matching output currents; and activating each remaining row of pixels of the plurality of rows of pixels, one at a time, and repeating the steps of supplying, receiving, comparing, storing, and using for each activated row.

22. A method as claimed in claim 21 wherein the step of supplying one current level in the plurality of current levels includes supplying the maximum current level.

23. A method as claimed in claim 21 wherein the step of supplying current level data includes sequentially supplying a plurality of selected current levels and the steps of receiving, comparing, storing, and using are repeated for each of the plurality of selected current levels for each pixel in each row of pixels.

* * * * *